US006192950B1

(12) United States Patent
Maeng

(10) Patent No.: US 6,192,950 B1
(45) Date of Patent: Feb. 27, 2001

(54) PROTECTIVE HINGED COVER FOR GOLF CLUB

(76) Inventor: Seop Maeng, 22-102, Hanyang Apartment, Songpa-Dong, Songpa Ku, Seoul (KR)

( * ) Notice: Subject to any disclaimer, the term of this patent is extended or adjusted under 35 U.S.C. 154(b) by 0 days.

(21) Appl. No.: 09/088,588

(22) Filed: Jun. 2, 1998

(30) Foreign Application Priority Data

Jun. 3, 1997 (KR) ..... 97-22848

(51) Int. Cl.[7] ..... A63B 57/00
(52) U.S. Cl. ..... 150/160; 206/315.2; 206/315.4
(58) Field of Search ..... 150/159, 160; 204/315.2, 315.4

(56) References Cited

U.S. PATENT DOCUMENTS

| | | | | |
|---|---|---|---|---|
| 2,128,546 | * | 8/1938 | Venmore | 150/160 |
| 2,508,525 | * | 5/1950 | Le Fevre | 150/160 |
| 2,705,039 | * | 3/1955 | Halter | 150/160 |
| 3,117,609 | * | 1/1964 | Pio | 150/160 |
| 3,613,760 | * | 10/1971 | Koehnle | 150/160 |
| 3,664,399 | * | 5/1972 | Neff | 150/160 |
| 3,892,267 | * | 7/1975 | Bibeau | 150/160 |
| 4,195,677 | * | 4/1980 | Hagg et al. | 150/160 |
| 4,378,832 | * | 4/1983 | Thompson | 150/160 |
| 5,000,238 | * | 3/1991 | Zeller | 150/160 |
| 5,050,655 | * | 9/1991 | Borenstein | 150/160 |

* cited by examiner

*Primary Examiner*—Sue A. Weaver
(74) *Attorney, Agent, or Firm*—Chapman & Cutler

(57) ABSTRACT

A protective cover for a golf club includes a pair of head covers coupled to each other to pivot vertically, about a horizontal axis, between open and closed positions, thereby achieving very accurate and rapid opening and closing a while ensuring a protection for the head and shaft of a golf club, received therein, against impacts and scratches. The protective cover includes a pair of shaft protectors extending downwardly from respective bottom walls of the head covers and adapted to protect the shaft of the golf club. A support member is hingably mounted, at opposite sides of an upper end thereof, to respective lower ends of the shaft protectors. The support member defines a space capable of receiving the shaft of the golf club therein. Two pairs of spaced hinge members are inwardly protruded from the inner surfaces of the lower ends of the first shaft protectors, respectively. Each of a pair of hinge mounting members is fixed to opposite outer surfaces there. Each of the hinge members is mounted to one of the hinge mounting members.

14 Claims, 4 Drawing Sheets

PROTECTIVE HINGED COVER FOR GOLF CLUB

BACKGROUND OF THE INVENTION

1. Field of the Invention

The present invention relates to a protective cover for a golf club adapted to protect the head and shaft of the golf club. More particularly, it relates to a protective cover for a golf club which includes a pair of head covers coupled to each other to hinge vertically (i.e., on at least one horizontal axis between an open and closed positions.

2. Description of the Prior Art

Referring to FIG. 1, a golf bag is illustrated, in which golf clubs are received. The golf bag 21 is partitioned, as by internal walls 22, to separately receive a plurality of golf clubs therein. The golf bag 21 also has a slope at the bottom thereof (not shown) so that the user can easily and conveniently extract any of golf clubs 1 from the golf bag 21 for use.

Golf clubs 1 are received in the golf bag 21 while being arranged together in parallel in such a manner that those having a shorter length are received in a front portion of the golf bag 21 whereas those having a longer length are received in a rear portion of the golf bag 21. Accordingly, the golf clubs 1 can be easily selected for use. However, when the user carries the golf bag 21, golf clubs 1 received therein will move and jostle, so that they come into contact with one another.

Where golf clubs 1 are received in the golf bag 21 in a manner shown in FIG. 1, the head 2 of a shorter one of the adjacent golf clubs 1 can come into contact with the shaft 3 of a longer golf club, thereby causing the shaft 3 of the longer golf club to be scratched. The paint layer on the surface of the shaft 3 may even be peeled off. This degrades in the appearance of the longer golf club.

In order to solve such a problem, a club cover 101P1 as illustrated in FIG. 2 has been proposed. As shown in FIG. 2, a head cover 4 encloses the head 2 of a golf club 1, and a shaft cover 5 encloses the lower portion of the shaft 3 of the golf club 1, adjacent the head 2.

This club cover 101P1 is put onto the club 1 before the golf club is received into the golf bag 21. The head 2 of the golf club 1 is put into an opening defined at the lower end of the shaft cover 5 when golf club 1 is held vertically, head up, the head 2 is enclosed by the head cover 4 and the shaft 3 is enclosed by the shaft cover 5.

This club cover 101P1 prevents the shaft 3 of the golf club 1 from being damaged due to movement occurring while carrying the golf bag, because the club cover 101P1 encloses both the head 2 and shaft 3.

However, the opening of know head cover 4 has a small dimension, taking into consideration the thin construction of the shaft 3 of the golf club 1. Due to such a small dimension of the opening, considerable effort is required to put the club cover 101P1 into the golf club 1 and to remove it. That is, the user should insert the head 2 of the golf club 1 into the opening of the head cover 4 while widening the opening by hand. For taking off the head cover, a strong force again is required to extract the head of the golf club through the narrow opening of the club cover.

Furthermore, when the golf club 1 with the head cover 101P1 is put into the golf bag 21, the shaft cover 5 may come into contact, at its lower end, with the heads of other golf clubs already received in the golf bag 21, the club covers of the latter golf clubs, or the upper ends of partitions provided in the golf bag 21. As a result, the club cover may shift upwardly.

When the head cover portion 5 of the head cover shifts upwardly at its lower end as mentioned above, the shaft 3 of the golf club 1 is exposed, so that it still may come into direct contact with other golf clubs. For this reason, to this club cover 101P1 still permits degradation in the appearance of the golf club shaft.

FIG. 3 illustrates another conventional golf club cover 101P2. This club cover has a cover body 11 adapted to enclose both the head 2 and the lower portion of the shaft 3 of a golf club 1. The cover body 11 is longitudinally slit to allow an easy insertion of the head 2 and shaft 3 of the golf club 1 into the head cover. The head cover also has a slide fastener 12 attached to the slit portion of the cover body 11. This club cover 101P2 , the slide fastener 12 attached to the cover body 11 is open for putting the club cover 101P2 onto golf club 1. Thereafter, the head 2 of the golf club 1 is inserted into the head cover through the wide opening of the head cover. After the insertion, the slide fastener 12 is closed. Thus, the club cover 101P2 is put onto the golf club 1, so that it protects the head 2 and the lower portion of the shaft 3.

However, this head cover still has an inconvenience in that the slide fastener 12 must be manipulated to be opened and closed every time the head cover is put onto the golf club and taken off from the golf club.

Typically, the head cover is made of a thick fabric in order to provide a buffering function. For this reason, the head cover is bulky, so that it unnecessarily occupies a large space. This results in a bulky structure of the golf bag 21 itself.

On the other hand, U.S. Pat. No. 5,547,193 discloses a "golf club cover". Similarly to the head cover of FIG. 2, the golf club cover of the '193 patent has a head cover portion adapted to enclose the head of a golf club, and a shaft cover portion extending downwardly from the head cover portion and serving to enclose the lower portion of the shaft of the golf club.

This golf club cover has a different configuration from the head cover of FIG. 2, only in that it has a longitudinal slot formed in the shaft cover portion, in order to conveniently insert the head and shaft of the golf club into the protective cover. However, this golf club cover still has an inconvenience in that the insertion of the head and shaft of the golf club into the protective cover is carried out under the condition in which the slot must be widened manually.

SUMMARY OF THE INVENTION

Therefore, an object of the invention is to solve the above mentioned problems involved in the prior art. A protective cover for a golf club includes a pair of head covers hingably coupled to each other to pivot on horizontal axes between open and closed positions, thereby achieving very accurate and rapid opening and closing while ensuring protection for the head and shaft of a golf club received therein against an external impacts.

This invention has several features, no single one of which is solely responsible for its desirable attributes. Without limiting the scope of this invention as expressed by the claims which follow, its more prominent features will now be discussed briefly. Its benefits include, but are not limited to, durability, ease of use, and protection for the head and shaft of a golf club.

A first feature of the protective cover of this invention is that it includes a pair of head cover members adapted to enclose a head of a golf club. Typically, each head cover member has a top wall, bottom wall, and a side wall connecting the top wall and bottom wall. The side wall of each head covers member has an open side, and these open sides face each. There is an opening in each of the bottom walls along an internal edge of the bottom wall disposed along the open side. These openings are aligned so that with the head cover members in the closed position the openings are adjacent each other to provide a passageway adapted to receive a shaft of a golf club.

A second feature is a coupling member adapted to hingably couple the head cover members to each other to hinge them vertically between an open state or position and a closed state or position. (As used herein, "vertically" refers to the head cover members opening and closing on a horizontal axis where the golf club shaft is oriented vertically.) Thus, in the open state or position the head cover members receive or give up the head of a golf club and in the closed state or position the head cover members form an enclosure adapted to cover or enclose a head of a golf club. The coupling means comprises one or more hinges.

A third feature is a spring adapted to urge the head cover members into the closed state or position. This spring normally urges the head cover members into the closed position but allows the head cover members to be manually moved into the open position. The spring may in the form an elastic or resilient member such as a spring or springs connected between the pair of head cover members. Upon release of the user's grasp, the spring automatically urges the head cover members to the closed position.

A fourth feature is that a protective bar is attached to extend from underside of each of the bottom walls. Each protector extends downwardly from the opening in each bottom wall. These protector surround the passageway upon moving the head cover members to the closed position.

A fifth feature is a support member having an open side for receiving a shaft of a golf club connected to the bottom walls of the head cover members. The support member, typically having a U-shaped configuration, is connected to the bottom walls of the head cover members by the shaft protective bars.

A sixth feature is that the hinges may be formed on or connected to the top walls of the head cover members, or with and between the shaft protectors and the support member.

DESCRIPTION OF THE PREFERRED EMBODIMENTS

Referring to FIGS. 4 to 8, three embodiments of protective covers for golf clubs having configurations according to the present invention are illustrated, at 101*a*, 101*b*, and 101*c*.

Figure 4:
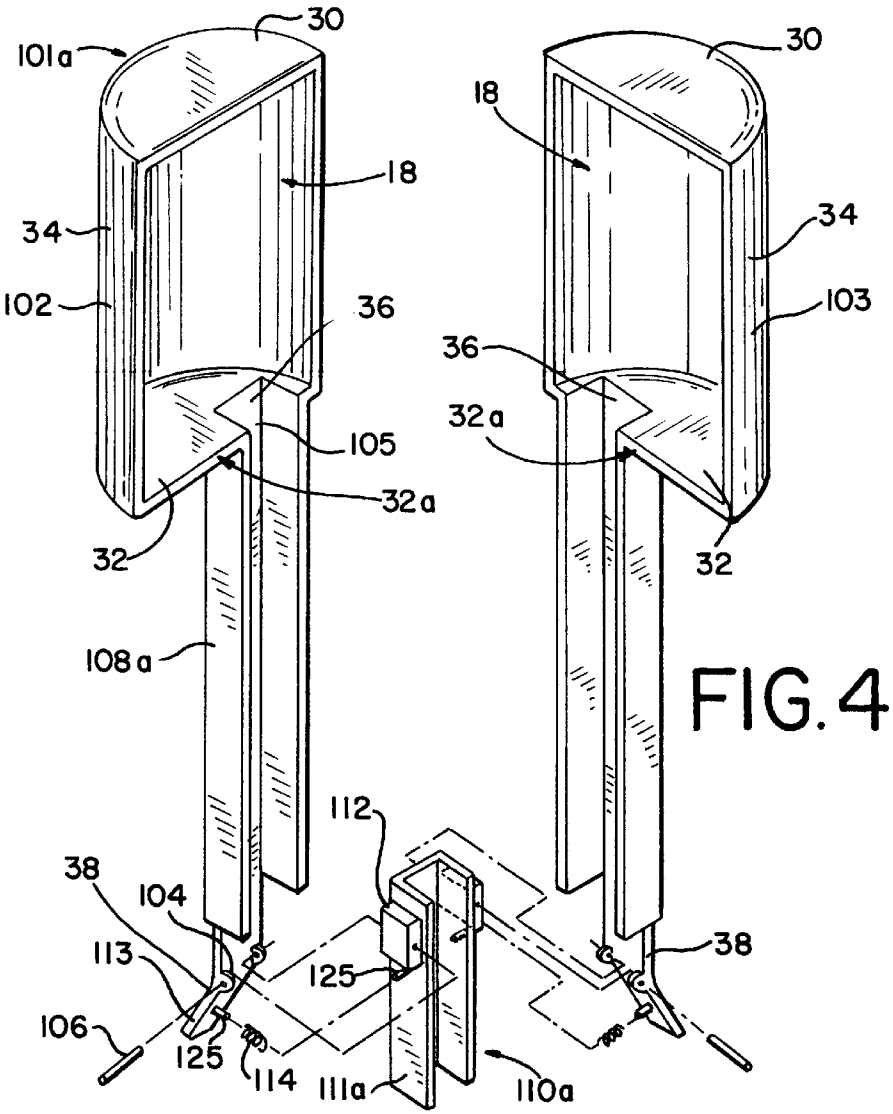
FIG. 4 is an exploded perspective view illustrating a protective cover according to one embodiment of the present invention.

As shown in FIG. 4, the protective club cover 101*a* includes a pair of head cover members 102 and 103. Each of the head cover members 102 and 103 has a semi-circular top wall 30, a semi-circular bottom wall 32, and a side wall 34 connecting the top and bottom walls. The sides 18 of the cover members 102 and 103 which face each other are open. A rectangular shaft hole 36 is formed along an edge 32*a* of the bottom walls 32 disposed adjacent to the rear ends of the side walls 34 of the head cover members 102 and 103. A pair of U-shaped shaft protectors 108*a* extend downwardly from respective bottom walls 32 of the head cover members 102 and 103 around the shaft hole 36. The shaft protectors 108*a* define a shaft protective space 105 therein. When a golf club is received in the protective cover 101*a*, the shaft of the golf club extends through the shaft receiving space 105.

The protective cover 101*a* also includes a head cover member coupler 110*a* to hinge the head cover members 102 and 103 to each other vertically (i.e., on horizontal axes) to move between open and closes positions. The head cover member coupler comprises a U-shaped support member 111*a* on which are hingably mounted, at hinge mounting members 112 affixed at opposite sides of the upper end thereof, respective lower ends of the shaft protectors 108*a*. The support member 111*a* has an internal passage for receiving the shaft of the golf club.

The head cover member coupler 110*a* employs two pairs of spaced hinge ears 104 inwardly protruded from inner surfaces of the lower ends of extensions 38. These extensions 38 are formed on the lower ends of the shaft protectors 108*a*. Each of the pair of hinge mounting members 112 engages one pair of the hinge ears 104 by means of a hinge pin 106. Accordingly, the head cover members 102 and 103, along with their shaft protectors 108*a* can pivot on the hinge pins 106.

A pair of grips 113 extend downwardly from the lower ends of the extensions 38, respectively, in order to conveniently open the protective cover 101*a* consisting of two separate head cover members. The grips 113 extend angularly outwardly and downwardly.

Each of a pair of compression coil springs 114 is arranged between the support member 111 and each grip 113. Each compression coil spring 114 is supported at both ends thereof by support protrusions 125 respectively protruded from the facing surfaces of the support member 111 and associated knob 113. The compression coil springs 114 serve to always urge the grips 113 in such a manner that the grips 113 move away from each other, thereby causing the head cover members 102 and 103 to be kept in their closed state.

The head cover members 102 and 103, the shaft protectors 108*a*, and the support member 111*a* of the protective cover 101*a* are molded using a synthetic resin material.

Figure 1:
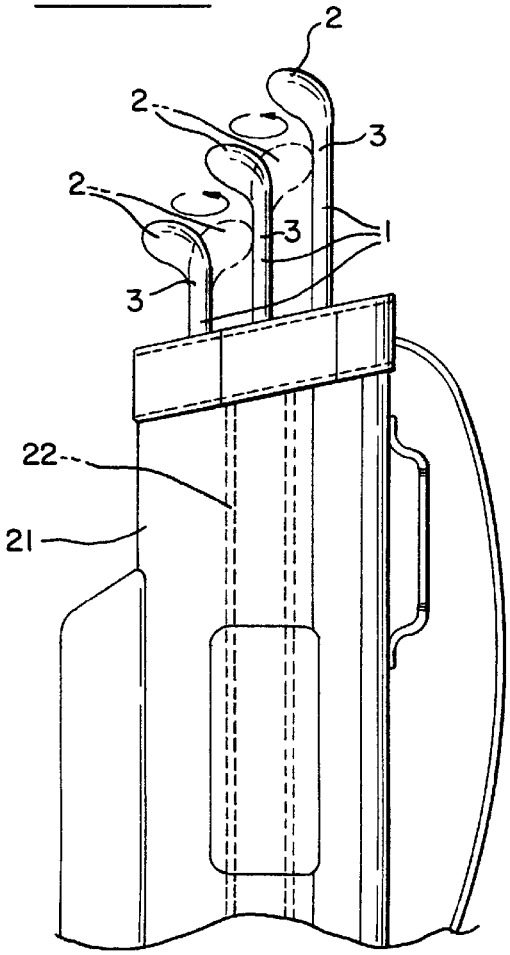
FIG. 1 PRIOR ART
FIG. 1 a side view illustrating golf clubs being received in a golf bag in a conventional manner.
Figure 2:
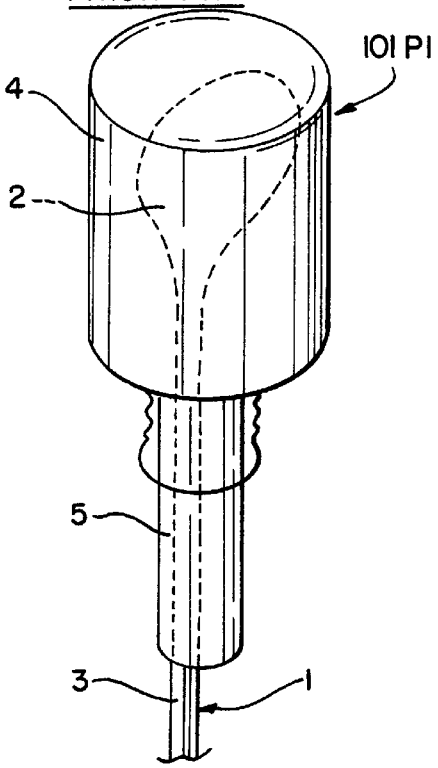
FIG. 2 PRIOR ART
FIG. 2 is a perspective view illustrating one conventional protective cover for a golf club.
Figure 3:
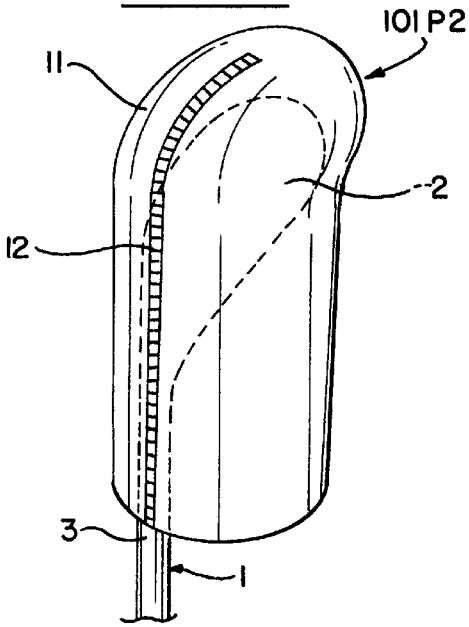
FIG. 3 PRIOR ART
FIG. 3 is a perspective view illustrating another conventional protective cover for a golf club.
Figure 5:
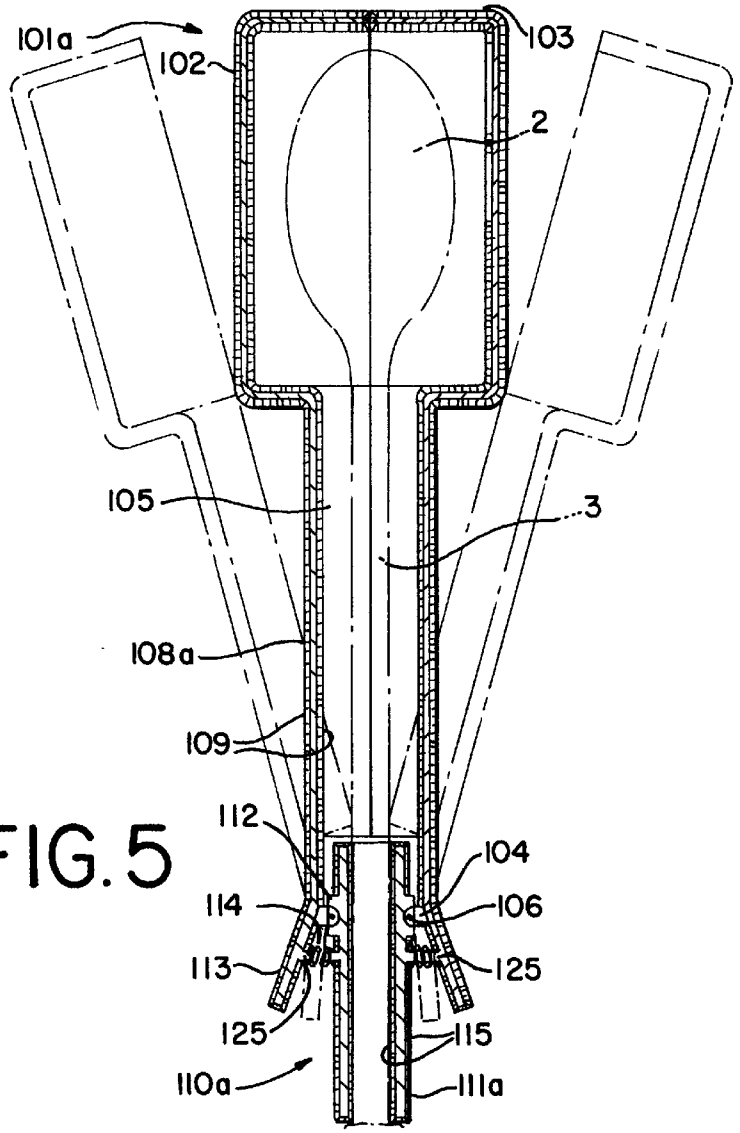
FIG. 5 is a sectional view illustrating operation and use of the protective cover of FIG. 4.

Fabrics 109, as in FIG. 5 are attached to the inner and outer surfaces of the head cover members 102 and 103 including the shaft protectors 108*a*. Fabrics 115 are also attached to the inner and outer surfaces of the support member 111*a*. The fabrics 109 and 115 serve to cushion the head cover members 102 and 103 against an external impact. Those fabrics also prevent the head and shaft of the golf club, received in the protective cover 101, from being scratched by the inner surfaces of the head cover members 102 and 103, shaft protective bars 108*a* and support member 111*a*.

When the user applies a force to the outwardly-bent grips 113 by hand, thereby moving those grips 113 toward each other against the resilience of the compression coil springs 114, the head cover members 102 and 103 along with their shaft protective bars 108*a* move about the hinge pins 106 to move the head cover members 102 and 103 away from each other. That is, the protective cover 101*a* is then open, as indicated by the phantom line of FIG. 5, in order to allow an insertion of a golf club thereinto.

When the user releases the force applied to the grips 113, after receiving the such as after placing a golf club head 2 and shaft 3 into the open protective cover 101*a*, the head cover members 102 and 103 and their shaft protective bars 108*a* move to their original closed state indicated by the solid line of FIG. 5 under forces from of the compression coil springs 114.

In this closed state, the head 2 of the golf club is received in a space defined by the head cover members 102 and 103 while the shaft 3 of the golf club is received in the shaft receiving space 105 defined by the shaft protective bars 108. Accordingly, the head 2 of the golf club and the lower portion of the shaft 3 adjacent to the head are prevented from coming into contact with other golf clubs received in a golf bag. Thus, those portions of the golf club are protected from degradations in their appearance.

Figure 6:
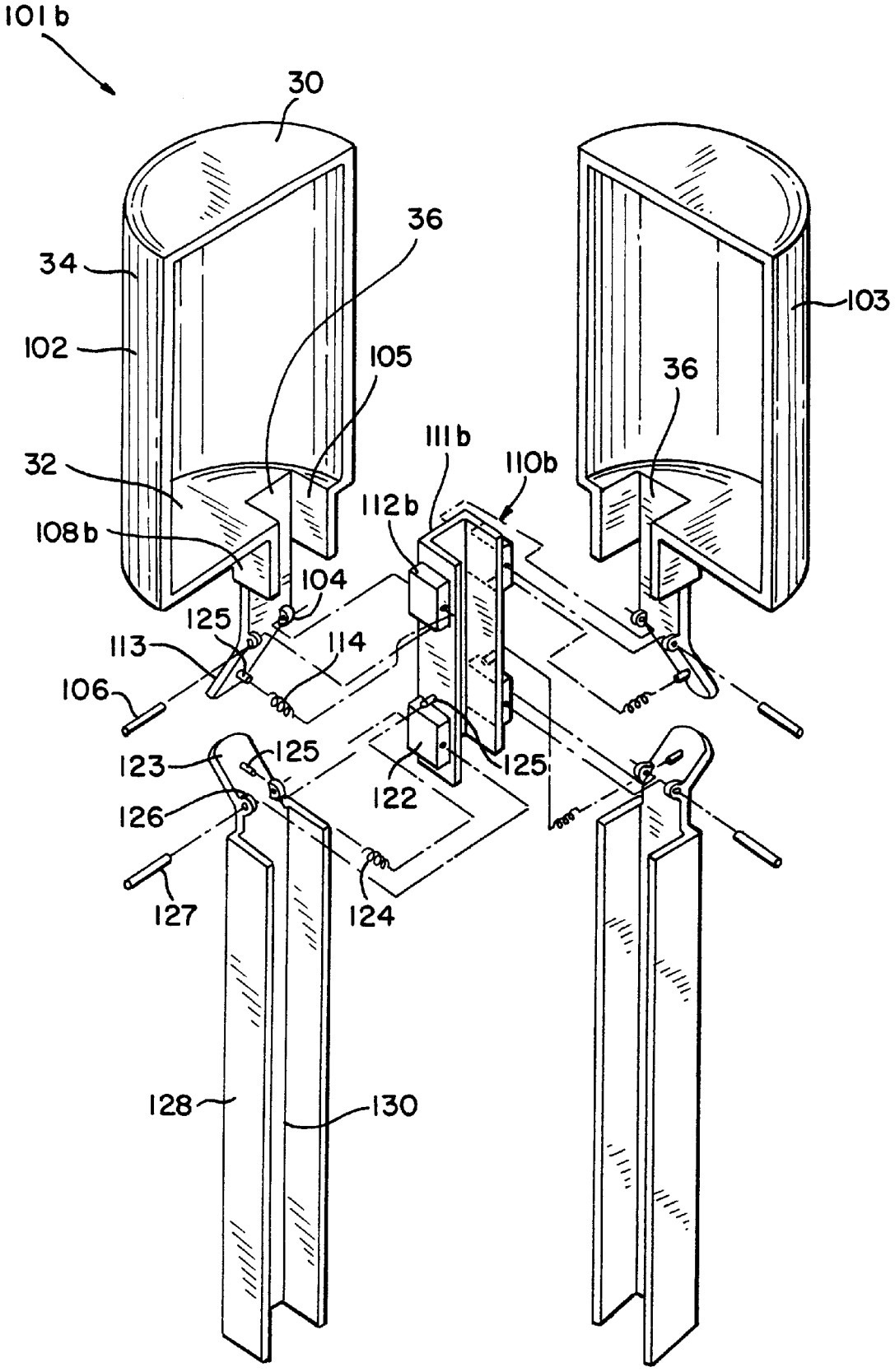
FIG. 6 is an exploded perspective view illustrating a protective cover according to a second embodiment of the present invention.
Figure 7:
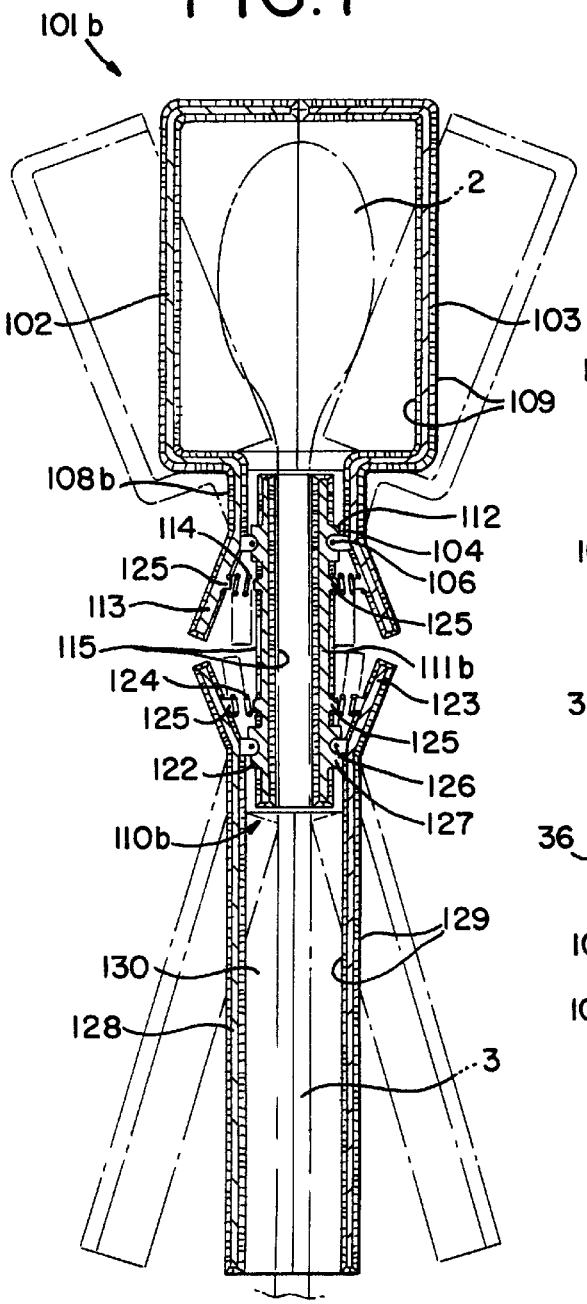
FIG. 7 is a sectional view illustrating operation and use of the protective cover shown in FIG. 6.

Referring to FIGS. 6 and 7, the second form of protective cover 101*b* modified from the structure of FIGS. 4 to 5, is illustrated. In accordance with this embodiment, the protective cover includes a pair of first shaft protectors 108*b* similar to those of FIGS. 4 and 5, but having a reduced length, and a pair of second shaft protectors 128 formed separately from the first shaft protector 108. Similarly to the shaft protectors 108*a* of FIGS. 4 and 5, the first shaft protectors 108*a* 108*b* extend downwardly from respective bottom walls 32 of the protective cover 101*b* around the shaft holes 36, in order to provide a shaft protective space. The first shaft protectors 108*b* are hingably mounted to a support member 111*b* by means of hinge ears 104*b* and hinge mounting members 112*b* attached to the upper end of the support member, 111*b*, and using hinge pins 106.

In order to hingably mount the second shaft protectors 128, the support member 111*b* is also provided at its lower end with a pair of hinge mounting members 122 fixed to opposite outer surfaces of the support member 111*b*, respectively. Two pairs of hinge ears 126 are also inwardly protruded from the inner surfaces of the upper ends of extensions from the upper ends of the second shaft protectors 128, respectively. The hinge ears 126 are hingably mounted to the lower hinge mounting members 122 by means of hinge pins 127.

In addition to the grips 113 provided at the lower ends of the extensions extending downwardly from the lower ends of the first shaft protectors 108*b*, a pair of second grips 123 extend upwardly from the upper ends of the extensions extending upwardly from the upper ends of the second shaft protective bars 128, respectively, in order to conveniently open the second shaft protective bars 128. The second knobs 123 extend outwardly and upwardly.

In addition to the compression coil springs 114, each of a pair of compression coil springs 124 is arranged between the support member 111*b* and each grip 123. Each compression coil spring 124 is supported at its ends by support protrusions 125*b* respectively protruded from the facing surfaces of the support member 111 and associated grip 123. The compression coil springs 124 serve to always urge the grips 123 away from each other, thereby causing the second shaft protective bars 128 to be kept in their closed positions.

In this case, in addition to cushioning fabrics 109*b* and 115*b*, fabrics 129 are also attached, as shown in FIG. 7, to the inner and outer surfaces of the second shaft protectors 128. The fabrics 129 have the same use and effects as the fabrics 109 and 115.

When the user applies a force to the grips 113*b* of the first shaft protective bars 108 and the grips 123 of the second shaft protective bars 128 by hand, those grips 113 and 123 are moved toward each other against the resilience of the compression coil springs 114 and 124. Then the head cover members 102 and 103, first shaft protective bars 108*b*, and second shaft protective bars 128 also move about the hinge pins 106 and 126 so that the head cover members 102 and 103 along with the first shaft protective bars 108*b* are moved away from each other while the second shaft protective bars 128 are moved away from each other. That is, the protective cover 101*b* is opened, as indicated by the phantom lines of FIG. 7, in order to allow insertion or removal of a golf club therein.

When the user releases the force applied to the knobs 113 and 123 such as after receiving the head and shaft of a golf club in the open protective cover 101*b*, the head cover members 102 and 103 and the second shaft protective bars 128 move to their original closed positions indicated by the solid lines of FIG. 7 under forces of the compression coil springs 114 and 124.

In this state, the head 2 of the golf club is received in a space defined by the head cover members 102 and 103 while the shaft 3 of the golf club is received in a shaft receiving space 105*b* defined by the first shaft protectors 108 and a shaft receiving space 130 defined by the second shaft protectors 128. Accordingly, the head 2 of the golf club and the lower portion of the shaft 3 adjacent to the head are prevented from coming into contact with other golf clubs received in a golf bag. Thus, those portions of the golf club are protected from degradation in their appearance.

Figure 8:
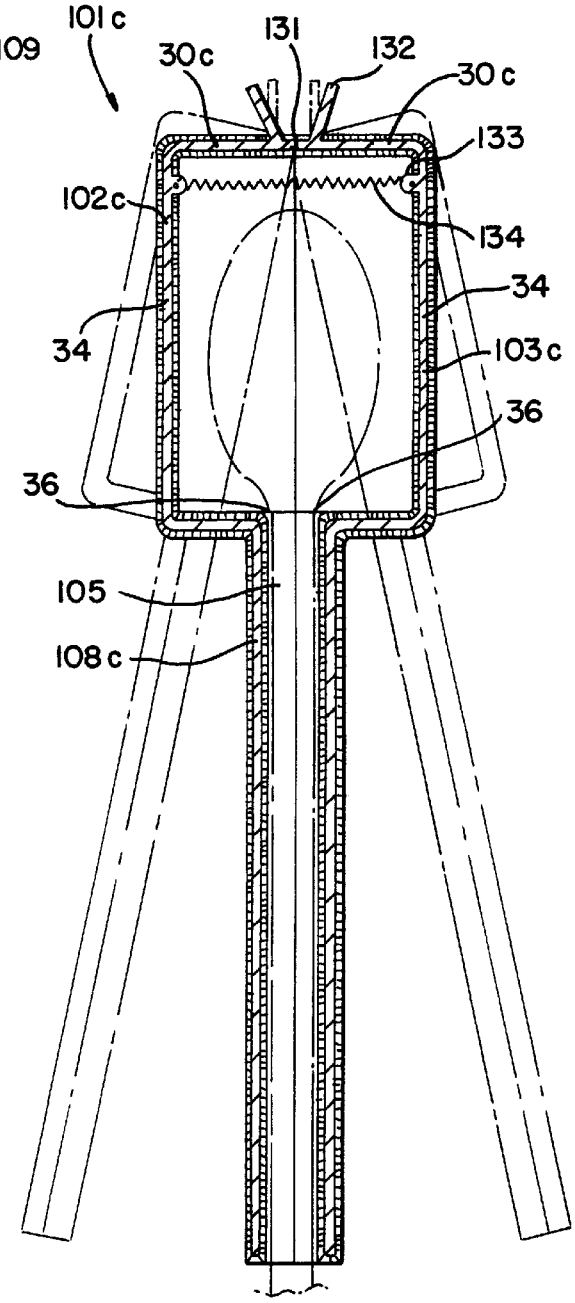
FIG. 8 is a sectional view of a protective cover according to a third embodiment of the present invention, illustrating operations of the protective cover.

FIG. 8 illustrates a protective cover 101*c* according to a third embodiment of the present invention, in which the protective cover again is configured to be vertically opened and closed (i.e., about horizontal axes). The protective cover of this embodiment has the same basic structure, including head cover members 102 and 103, shaft holes 36 and shaft protectors 108*c*, as that of FIG. 4. In accordance with this embodiment, the head cover member coupler comprises a hinge 131 provided at the contact portions of top walls 30*c* of the head cover members 102*c* and 103*c*. The hinge 131 couples the head cover members 102*c* and 103*c* to each other to pivot vertically, i.e., about the horizontal hinge 131, between open and closed positions. The head 2 of a golf club is received in the protective cover for storage and is removable from the protective cover for use. A pair of grips are formed on the top walls 30*c* of the head cover members 102*c* and 103*c* adjacent to the hinge 131, in order to conveniently open the head cover members 102*c* and 103*c*. The grips 132 extend outwardly and upwardly. To to keep the head cover members 102*c* and 103*c* closed, a tension spring 134 is arranged between upper portions of the facing inner surfaces of the side walls 34 of the head cover members 102*c* and 103*c*. The spring 134 is supported at both ends thereof by support protrusions 133 formed on the facing inner surfaces of the side walls of the head cover members 102*c* and 103*c*. The spring 134 serves to always urge the head cover members 102*c* and 103*c* into their closed state.

When the user applies a force to the grips 132 by hand, thereby moving those grips 132 toward each other against the resilience of the spring 134, the head cover members 102*c* and 103*c* along with their shaft protectors 108*c* pivot about the hinge 131 away from each other. That is, the protective cover 101*c* is opened, as indicated by the phantom lines of FIG. 8, in for insertion of a golf club thereinto.

When the user releases the force applied to the grips 132, as after receiving the head and shaft of the golf club into the open protective cover 101*c*, the head cover members 102 and 103 and the shaft protective bars 108 pivot back to their original, closed positions, as indicated by the solid lines of FIG. 8 under the force of the spring. Thus, the head and shaft of the golf club are protected from degradation in their appearance.

As is apparent from the above description, the present invention provides very accurate, rapid opening and closing while ensuring protection for the head and shaft of a golf club, therein against any impacts.

The present invention completely eliminates the problems of conventional protective covers.

In addition, since the protective cover of the present invention can be made of a synthetic resin material, its structure is light. Furthermore, easy manufacture in mass production is possible.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A protective cover for a golf club, the club having a head and a shaft affixed to the head, the cover comprising:

a pair of head cover members adapted to selectively enclose and to selectively release a head of the golf club, in a closed position the members protecting the head of the golf club, and each of the head cover members having a top wall, a bottom wall, and a side wall connecting the top and bottom walls;

a pair of shaft protectors extending downwardly from respective bottom walls of the head cover members and cooperating together to provide a protective space for protecting the shaft of the golf club in a portion thereof adjacent the head;

at least one head cover member coupler joining the head cover members together and to pivot on at least one horizontal axis, when the club shaft is oriented vertically, between an open position and a closed position in order to receive and store and protect the head and shaft of the golf club therein in said closed position and, in said open position, to permit taking of the protective cover from the head and shaft of the golf club for using the golf club; and spring means, operating between any two of (a) the coupler, (b) either of the head cover members, and (c) either of the shaft protectors, for urging the head cover members into the closed position.

2. The protective cover according to claim 1, wherein the head cover member coupler comprises:

an elongated support member hingably mounted, at opposite sides of an upper end thereof, to respective lower ends of the shaft protectors, the support member defining a space for receiving said portion of the shaft of the golf club therein;

two pairs of spaced hinge ears, each pair of said ears inwardly protruding from inner surfaces of lower ends of the shaft protectors, respectively; and a pair of hinge mounting members fixed to opposite outer surfaces of the support member at an upper end of the support member, respectively, so that each pair of the hinge ears are hingably mounted to an associated one of the hinge mounting members by a hinge pin, thereby enabling the head cover members along with the shaft protectors to pivot about the hinge pins.

3. The protective cover according to claim 2, further comprising:

a pair of second shaft protectors formed separately from the first shaft protectors and providing a second shaft protective space for protecting a further portion of the shaft of the golf club spaced from the head of the club;

two pairs of spaced hinge ears inwardly protruding from respective inner surfaces of upper ends of the second shaft protectors; and a pair of hinge mounting members fixed to opposite outer surfaces of the support member at a lower end of the support member, respectively, so that each pair of the hinge ears is hingably mounted to an associated one of the hinge mounting members by a hinge pin, thereby enabling the second shaft protectors to pivot about the hinge pins.

4. The protective cover according to claim 2, further comprising:

a pair of grips extending downwardly from the lower ends of the shaft protectors, respectively, in order to facilitate conveniently opening the head cover members and the shaft protectors, each of the grips extending outwardly and downwardly with the club head us and the shaft vertical.

5. The protective cover according to claim 4, wherein the spring means comprises a pair of springs each arranged between the support member and an associated one of the grips, the springs serving to always urge the grips away from each other, thereby causing the head cover members to be urged toward their closed position.

6. The protective cover according to claim 1, wherein the head cover member coupler comprises:

a hinge provided at contacting portions of the top walls of the head cover members and hingably coupling the head cover members to each other to pivot on said hinge between open and closed positions;

a pair of grips formed on the top walls of the head cover members adjacent to the hinge in order to facilitate conveniently opening the head cover members, the grips extending outwardly and upwardly; and wherein the spring means comprises a tension spring arranged between inner surfaces of the head cover members at upper portions thereof, the spring means serving to urge the head cover members into their closed position.

7. The protective cover according to claim 1, further comprising:

fabrics attached to respective inner and outer surfaces of the head cover members and the shaft protectors, the fabrics serving to cushion the head cover members against any external impact while preventing the head and the shaft of the golf club, received in the protective cover, from being scratched.

8. A protective cover for a golf club having a head and a shaft affixed to the head, the cover comprising:

a pair of head cover members, each head cover member having a top wall, a bottom wall, and a side wall connecting the top wall and the bottom wall yet leaving one portion of a side of each head cover member open, a hinge element which connects the head cover members together with the open sides facing each other and enables the head cover members to be manually pivoted on at least one horizontal axis when the club shaft is oriented vertically therein between an open position adapted to receive there between the head of the golf club and a closed position which forms an enclosure for the head, an opening formed in each of the bottom walls disposed along the open side, said openings in the bottom walls being aligned so that, with the head cover members in the closed position, said openings are adjacent each other to provide a passageway for receiving the shaft of the golf club, a pair of shaft protectors, each attached to and extending from one of the bottom walls at said openings to form a cover and a passageway for a substantial part of the length of the shaft of the golf club adjacent the head, and at least one spring member connected with and acting between either (a) the pair of head cover members or (b) the pair of shaft protectors, the spring member normally urging the pair of head cover members and the pair of shaft protectors into the closed position but allowing the head cover members and the shaft protectors to be manually manipulated and moved into the open position.

9. The protective cover of claim 8, wherein the hinge element operates between and upon the top walls of the head cover members.

10. The protective cover of claim 8, wherein the hinge element comprises a first hinge connected to one of the shaft protectors and a second hinge connected to the other shaft protector.

11. A protective cover for a golf club having a head and a shaft affixed thereto, the cover comprising:

a pair of head cover members, each providing a partial enclosure for the head of the golf club and each having a top wall, an open side, a bottom wall having an internal edge disposed along the open side, and a side wall extending between the top and bottom walls opposite to the open side, an opening in each of the bottom walls along said internal edge, said openings in the bottom walls being aligned so that with the head cover members in the closed position said openings are adjacent each other to provide a passageway adapted to receive the shaft of the golf club, a pair of shaft protectors, each extending from one of said bottom walls at said opening therein, and the shaft protectors having open sides and forming together a passageway for the shaft of the golf club, a hinge element which connects one of (a) the pair of head cover members and (b) the shaft protectors together, with the open sides facing each other to enable the head cover members to be manually moved, on at least one horizontal axis when the club shaft is vertical, between an open position adapted to receive there between the head of the golf club and a closed position to form an enclosure therefor, and a spring member contacting and acting between either of (a) the pair of head cover members and (b) the pair of shaft protectors, adjacent said hinge element, to urge the head cover members and the shaft protectors toward the closed position.

12. The protective cover of claim 11, wherein the hinge element is connected to the top walls of the head cover members.

13. The protective cover of claim 11, further including a spring member acting between the head cover members to urge them into the closed position.

14. The protective cover of claim 11, further comprising a support member hinged to each of the shaft protectors at spaced, parallel axes and having an open side for receiving therein the shaft of the golf club.

* * * * *